United States Patent [19]

Stewart

[11] Patent Number: 4,499,030

[45] Date of Patent: Feb. 12, 1985

[54] REVERSIBLE HOUSING FOR EVAPORATIVE COOLER

[76] Inventor: Biven Stewart, 5402 E. Pinchot, Phoenix, Ariz. 85018

[21] Appl. No.: 571,074

[22] Filed: Jan. 16, 1984

[51] Int. Cl.[3] ..... B01F 3/04

[52] U.S. Cl. ..... 261/3; 261/106; 261/29

[58] Field of Search ..... 261/3, 4, 5, 6, 29, 261/28, 106

[56] References Cited

U.S. PATENT DOCUMENTS

| | | | |
|---|---|---|---|
| 2,590,779 | 3/1952 | Lehmann | 261/106 |
| 3,063,766 | 11/1962 | Goettl | 312/31.03 |
| 3,126,428 | 3/1964 | Ash | 261/29 |
| 3,290,020 | 12/1966 | Findley | 261/29 |
| 3,936,515 | 2/1976 | Barreto | 261/29 |
| 4,145,384 | 3/1979 | Wagaman et al. | 261/35 |
| 4,154,355 | 5/1979 | Shackelford | 220/4 B |
| 4,234,526 | 11/1980 | Mackay et al. | 261/106 |
| 4,284,128 | 8/1981 | Nelson | 165/48 R |
| 4,428,890 | 1/1984 | Harrell | 261/29 |
| 4,439,375 | 3/1984 | Koble, Jr. | 261/29 |

*Primary Examiner*—Tim Miles

*Attorney, Agent, or Firm*—Warren F. B. Lindsley

[57] ABSTRACT

An evaporative cooler structure with provision for reversing the positions of the sump pan and top cover to permit continued service of the original equipment after corrosion of the sump pan results in water leaks. Reversal of top and bottom panels is facilitated through the provision of special mounting means for the water delivery "spider" and delivery tubes.

7 Claims, 7 Drawing Figures

REVERSIBLE HOUSING FOR EVAPORATIVE COOLER

BACKGROUND OF THE INVENTION

One of the most cost-effective and energy-efficient cooling systems for use in arid climates is the evaporative cooler. Evaporative coolers utilize the well known principle of heat absorption by moisture evaporation to cool or condition dry ambient air from the outside prior to its delivery into an enclosure such as a home or other building. The basic components of an evaporative cooler generally include an outer housing or shell which encloses evaporative pads, a water pump and distribution system to wet the evaporative pads, and a motor-driven blower or fan which draws the hot, dry ambient air through louvered side walls and through the moistened pads, causing evaporation of the water from the pads. As the water evaporates, the heat of vaporization is absorbed from the ambient air and the evaporatively cooled air is then directed into the building through a duct leading from the cooler.

An evaporative cooler requires periodic maintenance that is typically handled by the owner. Such periodic maintenance includes replacement of the evaporative pads, lubrication of the blower and motor, clearing of clogged water lines, etc. The maintenance problem is aggravated by the introduction into the water of dust and other foreign matter from the air, minerals in the water and particles of filter pad material. Algae and mold readily form and grow in the moist pads and throughout the water circulation system. All of these conditions lead to scale buildup, and corrosion of metal parts.

The present invention is directed toward the incorporation of certain features in the design of the evaporative cooler which reduce maintenance time and expense and extend the useful life of the original equipment. A specific feature of the design is interchangeability of the sump pan with the top cover of the cooler housing.

DESCRIPTION OF THE PRIOR ART

Related prior art devices and apparatus are described in U.S. Pat. Nos. 3,063,766, 3,936,515, 4,234,526, 4,145,384 and 4,284,128.

U.S. Pat. No. 3,063,766 discloses a cooler pan and frame construction for an evaporative cooler, the frame construction incorporating a sump pan and a top cover. The sump pan and the top cover are similar in construction, but they are not interchangeable.

U.S. Pat. No. 3,936,515 discloses a humidifier having a drawer-type reservoir which can be inserted and removed as necessary through an opening in the cabinet.

U.S. Pat. Nos. 4,234,526 (Mackay) and 4,284,128 (Nelson) disclose evaporative type air coolers having water receptacles.

SUMMARY OF THE INVENTION

In accordance with the invention claimed an improved evaporative cooler housing is provided together with other features which enhance the maintainability of the evaporative cooler, reducing maintenance time and expense and extending the useful life of the original equipment.

It is, therefore, one object of this invention to provide an improved housing construction for an evaporative cooler.

Another object of this invention is to incorporate in such an improved housing construction certain features which enhance the maintainability of the evaporative cooler.

A further object of the invention is to incorporate in the design of the evaporative cooler and its housing features which reduce maintenance costs and extend the useful life of the original equipment.

A still further object of the invention is to incorporate in the water circulation system a particularly effective filtering device which reduces contamination and blockage of the water distribution system, thereby reducing the frequency of cleaning operations required in connection with clogged water lines and water delivery troughs.

A still further object of the invention is to incorporate interchangeable top and bottom frame members so that the positions of these two members may be reversed when corrosion of the lower member prevents its continued use as a sump pan.

A still further object of the invention is to incorporate in the design of the evaporative cooler structure the necessary degree of symmetry to permit the inversion of the entire structure as a means for interchanging the functions of the top and bottom frame members.

A still further object of the invention is to incorporate in the frame structure identical top and bottom frame members so that their positions may be reversed when corrosion of the bottom frame member renders this member unuseable as a watertight sump but does not yet preclude its use as a top cover.

A still further object of the invention is to extend the useful life of the equipment beyond the occurrence of excessive corrosion of the lower housing member, such extension of equipment life being effected without the necessity of purchasing replacement parts.

Further objects and advantages of the invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described with reference to the accompanying drawing in which.

DESCRIPTION OF THE PREFERRED EMBODIMENT

Figure 1:
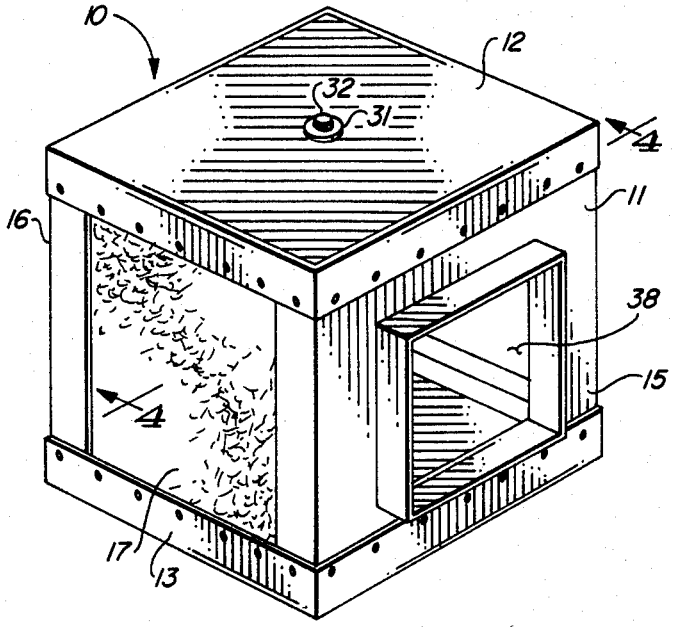
FIG. 1 is a perspective view of the improved evaporative cooler of the invention.

Referring more particularly to the drawing by characters of reference, FIGS. 1–6 disclose the reversible evaporative cooler structure 10 of the invention. The structure 10 comprises an outer frame 11 including identical top and bottom members 12 and 13, an air exhaust panel 15, corner supports 16, evaporative pad panels 17, water delivery system or "spider" 18, air delivery system 19, water delivery tube support 21, and water filter 22.

The structure 10 is symmetrical, top to bottom, as needed to achieve the reversibility feature which is key to this invention. As already mentioned, the top and bottom members 12 and 13 are identical so that either member may serve as a top cover to which the water delivery system 18 may be secured or as a bottom pan or sump in which an overflow pipe 23 may be mounted. The air exhaust panel 15 and the openings in the other three vertical faces of the frame 11 which hold the evaporative pad panels 17 are also symmetrical, top to bottom, so that the entire structure may be mounted with either end up or down.

Figure 2:
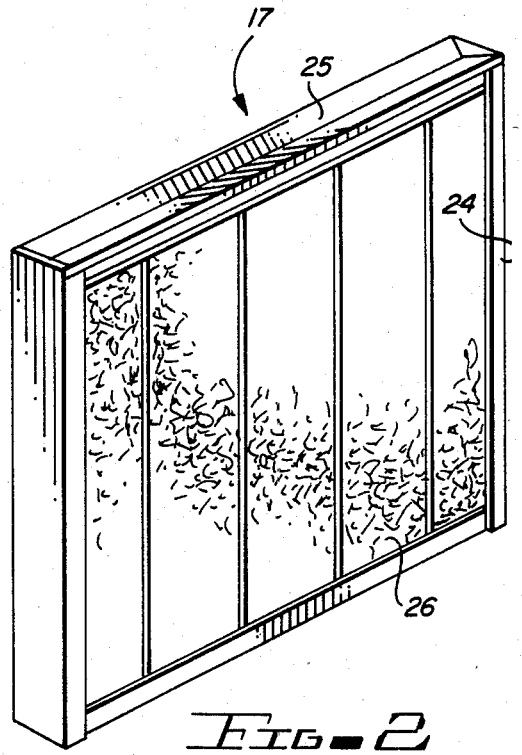
FIG. 2 is a perspective view of an evaporative pad and its supporting frame as employed in the cooler frame of FIG. 1.

The pad panel 17 as shown in FIG. 2 comprises a rectangular frame or grid 24, a water distribution trough 25 and a water pad 26. The grid 24 is fashioned in some manner to permit replacement of the pad 26 after it has become contaminated or no longer serviceable for whatever reason. The pad is typically of excelsior or of a newer synthetic material, its purpose being to provide a zone of moist material surfaces with air passages interposed. The trough 25 extends across the top of the frame or grid 24. Water supplied to the trough 25 partially fills the trough from end to end and drips down into the pad 26 through small holes uniformly distributed along the length of the trough.

Figure 4:
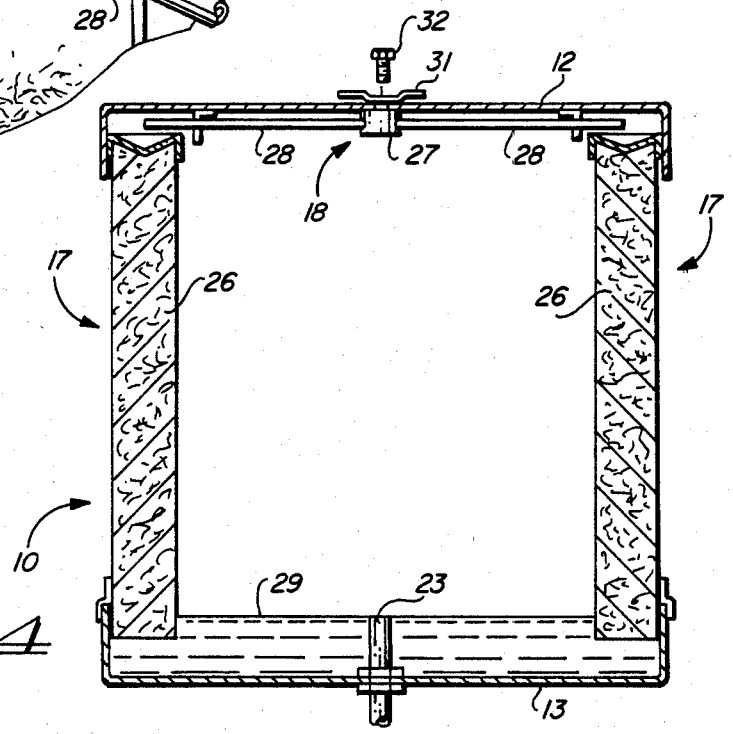
FIG. 4 is a cross-sectional view of the evaporative cooler as seen along line 4—4 of FIG. 1.
Figure 6:
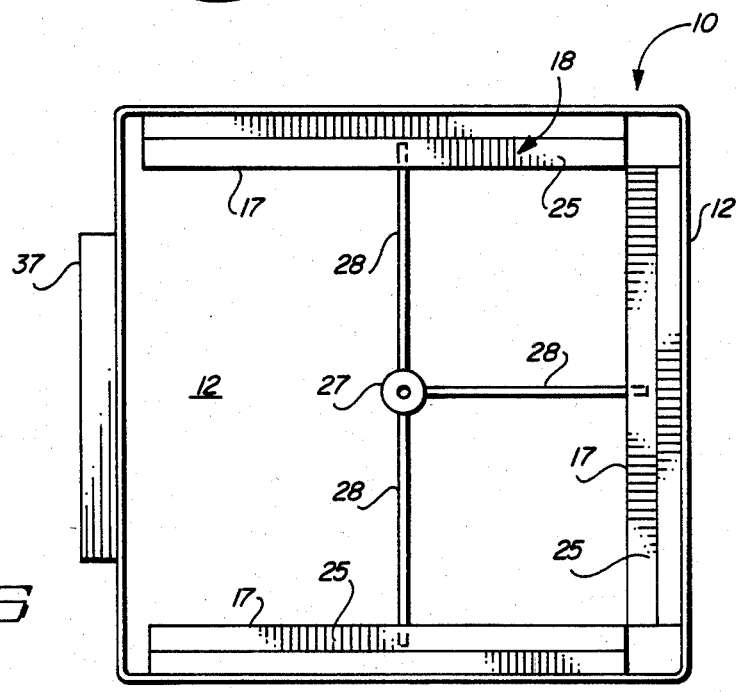
FIG. 6 is a plan view showing the underside of the top frame member with its water delivery system.

The water delivery system or "spider" 18 as shown in FIGS. 4 and 6 comprises a manifold 27 and water tubes 28 which extend outward from the manifold to the tops of the pad panels 17. A small pump, not shown, circulates water 29 from sump 13 to manifold 27 so that water from sump 13 passes through the pump to manifold 27, from manifold 27 through the tubes 28 to the troughs 25, downward through the pads 26 and back to the sump 13. Water lost by evaporation is replaced through a float-controlled valve, not shown, that opens into sump 13. In the event of a valve failure, the sump 13 overflows into overflow pipe 23 which carries excess water to the ground.

Because each of the members 12 and 13 must serve either as a top cover or as a sump pan, provision must be made for alternate connection of the "spider" 18 or the overflow pipe 23. Because the overflow pipe 23 requires a substantially larger opening at the center for passage through the member, a large washer 31 is provided for mounting the "spider" 18 in the identically dimensioned opening in the member 12 or 13 serving as the top cover. The washer 31 is formed to a concave configuration to afford a more secure support for the "spider" that will assure for it a centered positioning relative to the enlarged opening in the top cover. A screw 32 is passed through the washer 31 and into a threaded hole in manifold 27 to effect the mounting of the manifold to member 12.

Figure 3:
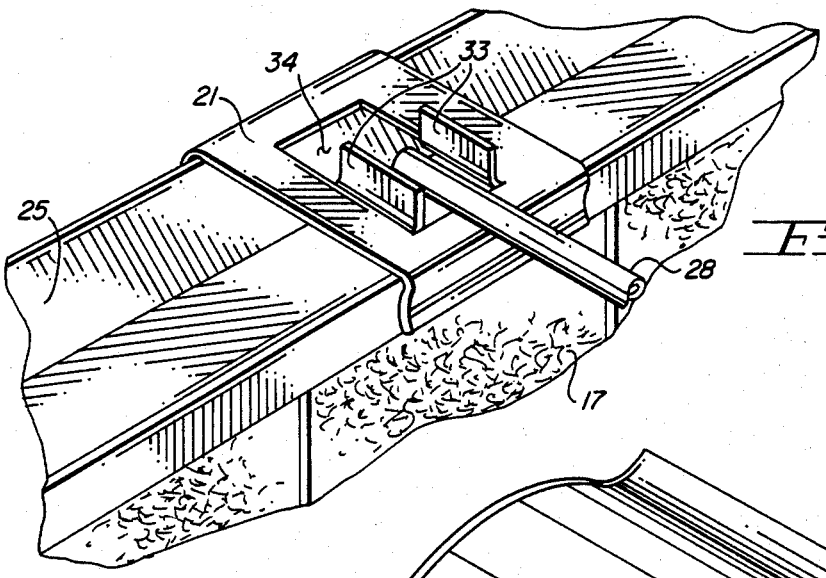
FIG. 3 is a perspective view of a special device intended as a support for the end of a water delivery tube, the device shown in position over the top of the cooler pad frame.
Figure 7:
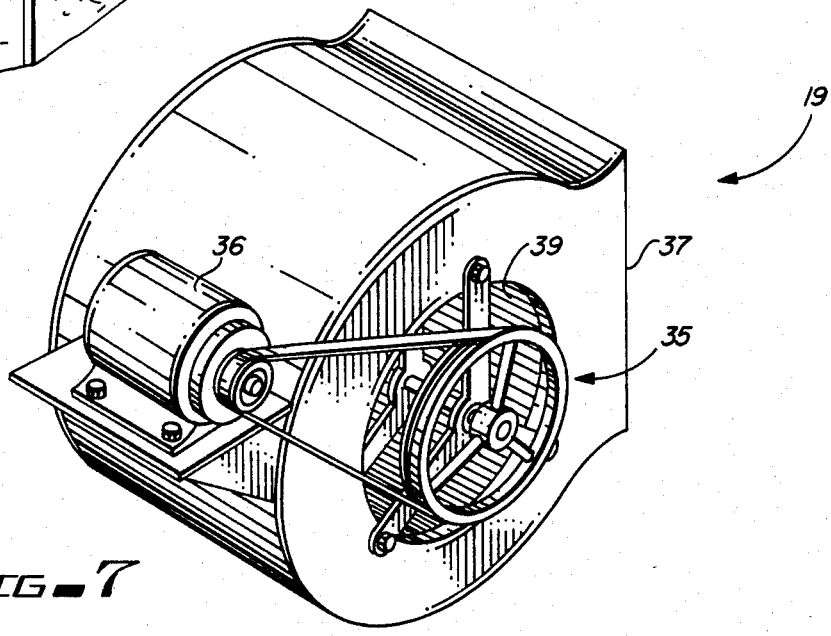
FIG. 7 is a perspective view of the blower and motor assembly as employed in the evaporative cooler of FIG. 1.

The outer ends of the tubes should preferably be secured in position during operation so that they will not be buffeted and moved about by vibrations originating from the blower and air delivery system 19. If such supports were provided as integral parts of the members 12 and 13, they would become contaminated or corroded during the service of the member as a sump pan. Subsequent use of the same member as a top cover would then be hindered by the deteriorated condition of the tube support. To counter this problem, the present invention provides the special tube support 21 as shown in FIG. 3. The support 21 is in the form of a clip that slips over the top of the pad panel 17. Vertically extending tabs 33 located at opposite sides of a centered opening 34 in support 21 serve to confine the end of the tube to the area of the opening 34. If desired, the spacing between the tabs 33 may be dimensioned to assure a gripping action between the tabs 33 and the tube 28. Because the support 21 is always mounted at the top of the panel 17 and never in the member 12 or 13 during service as a sump pan, the corrosion associated with such service is effectively eliminated. Numerous variations in the design of the support 21 are possible without departing from the spirit of the invention.

The air delivery system 19 comprises a blower or fan structure 35 and a motor 36. The rectangular air outlet 37 of the blower structure is secured to panel 15 of structure 10 so that blower outlet air passes through opening 38 of structure 10 as shown in FIG. 1. An external duct attached at opening 38 carries the exhausted air to the structure being cooled. The motor 36 is secured to the blower structure 35 at an elevation corresponding to the center of the blower so that the elevation of the motor is not affected by a reversal of the structure 10. During operation of the evaporative cooler, air enters the structure 10 through the moistened pads 26, passes into the blower 35 via the open ends of the squirrel cage fan 39 and exhausts through opening 37 into the external duct that carries the cooled air to the dwelling or other structure being served.

Figure 5:
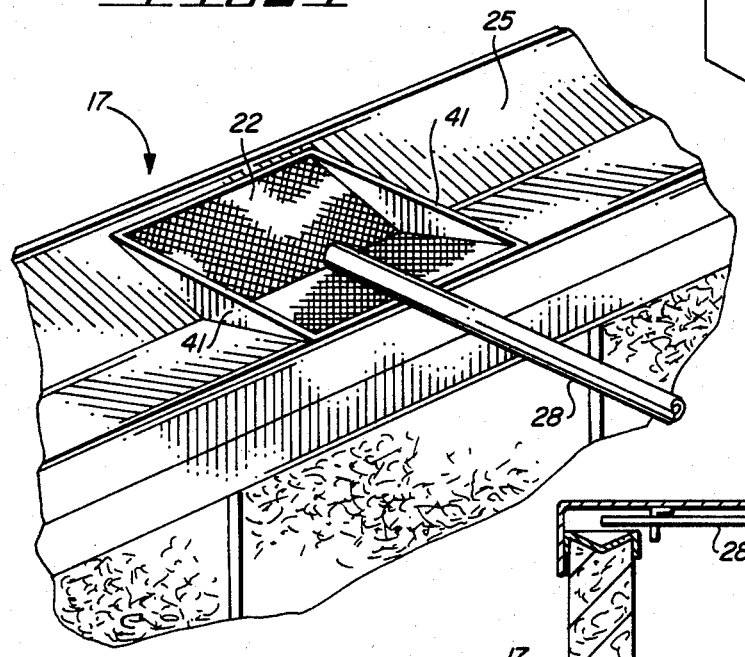
FIG. 5 is a perspective view showing a special water filter installed in the water delivery trough of the pad frame of FIG. 2.

To counter the water contamination problem discussed earlier, a special water filter 22 is provided as shown in FIG. 5. The filter 22 is formed from a screen material into a trough that has contours matching or approximating those of the trough 25 that is formed in the top of pad frame 17. The ends of the filter 22 are closed by vertical walls 41, also preferably of the same screen material. The filter 22 is positioned in trough 25 directly beneath the outer end of tube 28 so that any foreign matter such as bits of excelsior that are discharged with the water from tube 28 will be trapped by the filter and will not interfere with the delivery and distribution of the water to the pads 26 via the small holes at the bottom of trough 25.

It will now be readily apparent that when the lower member 13 becomes corroded after a period of service as a sump pan and its continued service in this capacity is no longer feasible because of water leaks, the system 10 may be repaired by reversing the entire structure 10, top for bottom, or by interchanging the top and bottom members 12 and 13. In either case, it will be found a simple matter to remount the water delivery "spider" 18 and the overflow pipe 23 in the repositioned member 12 or 13. Because the corrosion that has rendered the one member 12 or 13 unserviceable as a sump pan will not prevent its further service as a top cover, the system 10 may be returned to service by such an interchange without requiring the purchase of replacement parts.

The system 10 as described thus effectively meets the stated objects of the invention, and although but a single embodiment of the invention has been illustrated and described, it will be apparent to those skilled in the art that various changes and modifications may be made therein without departing from the spirit of the invention or from the scope of the appended claims.

What is claimed is:

1. An evaporative air temperature conditioner adapted for installation to draw and impel exterior air into a building comprising:

a housing having a generally horizontal positionable bottom pan-like member forming a sump, a similar generally horizontally positioned but inverted top pan-like member and upstanding side members, the side, top and bottom members being connectable to form a space therewithin to enclose an air blower means, at least one air admitting, air permeable, water impregnable pad mounted in one of said side members and closing an opening provided therefore, another of said side members providing an opening for sealably receiving an air duct means which is connectable with the air blower means mountable in said housing, each bottom and top member being provided with an aperture extending therethrough in a common location, a water overflow pipe, means for connecting said pipe to extend through said aperture in said bottom member with one end thereof positioned a predetermined distance above an inside surface of said bottom member, and the other end of said pipe being connectable to a drain pipe, a water delivery means, means extending through said aperture in said top member for connecting said water delivery means to an inside surface of said top member, said water delivery means having one end positioned over the top of said pad and its other end connectable to a pump mounted in the sump formed by said bottom member, said top and bottom members being interchangeable with each other such that when said top member is inverted to form the bottom of the housing it forms a sump and said overflow pipe is connectable with said aperture formed therein, and said bottom member when inverted forms the top of said housing with said water delivery means connectable through its aperture to complete a water delivery system to the top of said pad.

2. The evaporative air temperature conditioner set forth in claim 1 wherein:

said apertures in said bottom member and in said top member are centrally positioned therein.

3. The evaporative air temperature conditioner set forth in claim 1 wherein:

said opening in said another of said sides is positioned in the center of this side, whereby said housing may be inverted to cause said bottom member to become the top of said housing and said top member to become the bottom of said housing.

4. The evaporative air temperature conditioner set forth in claim 1 in further combination with:

a dual purpose clamp for resting on the top and clamping to the sides of said pad and for securing to said clamp said one end of said water delivery means.

5. The evaporative air temperature conditioner set forth in claim 4 wherein:

said clamp comprises a first inverted U-shaped portion the legs of which clamp to the sides of said pad, and a second U-shaped portion the bight of which is secured to the bight of said first portion with its legs extending diametrically opposite to the legs of said first portion and approximately 90 degrees thereto, the legs of said second portion securing said clamp to said water delivery means.

6. The evaporative air temperature conditioner set forth in claim 1 in further combination with:

a trough-like strainer for mounting on the top of said pad, and means for positioning said one end of said water delivery means in said strainer, said strainer filtering the water before absorption by said pad.

7. The evaporative air temperature conditioner set forth in claim 1 wherein:

said bottom member and said top member are substantially identical in their geometrical configuration.

* * * * *